US006572569B2

(12) United States Patent
Klein

(10) Patent No.: US 6,572,569 B2
(45) Date of Patent: Jun. 3, 2003

(54) EROTIC STIMULATION DEVICE

(76) Inventor: Eric A. Klein, 235 College Ave., Mountain View, CA (US) 94040

( * ) Notice: Subject to any disclaimer, the term of this patent is extended or adjusted under 35 U.S.C. 154(b) by 40 days.

(21) Appl. No.: 10/100,933

(22) Filed: Apr. 29, 2002

(65) Prior Publication Data

US 2002/0115948 A1 Aug. 22, 2002

Related U.S. Application Data

(62) Division of application No. 09/543,050, filed on Apr. 5, 2000, now Pat. No. 6,419,649.

(51) Int. Cl.[7] ..... A61H 1/00
(52) U.S. Cl. ..... 601/70; 601/69; 601/79
(58) Field of Search ..... 601/70–75, 69, 601/46, 78–81; 128/842, 861; 606/234–236

(56) References Cited

U.S. PATENT DOCUMENTS

| | | | | | |
|---|---|---|---|---|---|
| 4,459,645 | A | * | 7/1984 | Glatter | 174/50.55 |
| 4,740,196 | A | * | 4/1988 | Powell | 604/75 |
| 5,470,303 | A | * | 11/1995 | Leonard et al. | 600/38 |
| 5,657,765 | A | * | 8/1997 | Est | 128/842 |
| 5,660,597 | A | * | 8/1997 | Fox et al. | 601/49 |
| 5,967,784 | A | * | 10/1999 | Powers | 433/229 |
| 6,382,815 | B1 | * | 5/2002 | Klearman et al. | 362/104 |
| 6,468,294 | B2 | * | 10/2002 | Griffith | 606/234 |

* cited by examiner

*Primary Examiner*—Nicholas D. Lucchesi
*Assistant Examiner*—Fenn C Mathew

(57) ABSTRACT

A sexual aid device comprising a battery powered electric vibrator which attaches to the user's tongue. The first embodiment attaches to the tongue using a post (18) which is inserted through a hole previously pierced in the tongue. The assembled device is shaped roughly like a dumbbell consisting of a post (18) with retainers mounted at either end. Post (18) has a diameter narrow enough to fit through the tongue hole, but the retainers have larger diameter and cannot slip through the hole. An electric vibrator motor (14) is incorporated into one of the retainers. At least one of the retainers must be removable to allow device insertion. An electric battery (13) may be mounted in the same retainer as the vibrator motor (14) or in the other retainer. The second embodiment attaches to the tongue using suction, constriction, and friction. The front end of the device houses a vibrator mechanism comprising a vibrator motor (14), battery (13), and switch (38) in a moisture resistant housing (11). A pliable plastic mouthpiece (31) is mounted at the rear of the device. The interior of mouthpiece (31) forms a tongue cup (32) into which the user inserts the tongue. Tongue cup (32), when partially evacuated of air, acts as the means of attachment to the tongue A sealing lip (33) circles the rim of tongue cup (32). Sealing lip (33) both constricts the tongue and forms an airtight seal against the skin of the tongue. Concentric friction ridges (34) circle the interior of tongue cup (32). Friction ridges (34) grip the tongue and act as secondary air seals.

10 Claims, 6 Drawing Sheets

EROTIC STIMULATION DEVICE

This application is a division of application Ser. No. 09,543,050, filed Apr. 5, 2000, now U.S. Pat. No. 6,419,649.

BACKGROUND OF THE INVENTION

This invention relates to sexual aid devices, specifically to those devices that are used by couples and that attach to the body.

There exist a number of devices designed to enhance the quality of sexual activity between partners. Their use is accepted and even promoted by marriage counselors, sexual educators, physicians and the like as an aid in maintaining a healthy and satisfying sexual relationship. That the demand for these devices is substantial is evidenced by the existence of the well-established commercial industry that manufactures and sells them.

Many sexual devices incorporate an electric vibrator to enhance sexual sensation. These devices are most commonly referred to simply as vibrators. Vibrators are produced in a wide variety of shapes and sizes. When used by one partner to stimulate the other, vibrators are most commonly held in the hand, attached to the hand, attached to one or more fingers of the hand, or attached to the body so as to project from the groin area.

The hands, the genitalia, and the mouth are the parts of the body most commonly utilized for sexual touch. Vibrators which are held or attached to the hand or attached at the groin are commercially common, while vibrators which attach at the mouth are commercially uncommon and even unavailable.

The tongue is the most mobile feature of the mouth. Mounting a vibrator on the tongue, however, presents several difficulties. The end of the tongue is pliable and can vary in shape from a blunt cone to a rounded flattened wedge. The surface of the tongue is smooth and slippery. The tongue is sensitive to pain. Any means of attachment needs to be comfortable, secure, simple and quick to attach and detach.

A technique, piercing, exists for attaching jewelry to the tongue. An object with an attached post is fastened to the tongue by inserting the post through a previously pierced hole then attaching another object to the other end of the post to prevent the post from slipping back out. The assembled object has roughly the shape of a dumbbell. However, this technique has never, to the inventor's knowledge, been used to attach any electrically powered device, such as a vibrator, to the tongue.

U.S. Pat. No. 5,657,765 issued to Steven S. Est on Aug. 19, 1997 discloses an Erotic Stimulator in the form of an enlarged tongue that comprises a flexible elongated member having a mouthpiece at its base end whereby a user can manipulate the stimulator while leaving the hands free during gynecological stimulation with the device. This device has a length greater than three inches, is semi-rigid and non-hollow, and is held to the mouth by biting a mouthpiece. The device may optionally incorporate vibration capability.

Although the Est device is designed to look like a tongue, it cannot move like a tongue. It would be possible to move the device up and down in a limited manner by shifting the jaw, but side to side and in and out movement can only be accomplished by moving the entire head. The user's real tongue, lips, and jaw are immobilized. The user is unable to speak.

U.S. Pat. No. 5,460,597 issued to George Hopper on Oct. 24, 1995 discloses a hand-held stimulator for use in marital orgasmic and sexual therapy for performing a simulation of cunnilingus. The simulator has an elongated cylindrical housing, simulated lips, a simulated tongue and is battery powered. The tongue is caused to move in and out with respect to the simulated lips; up and down; and side to side. These motions are attainable independently of the others.

The Hopper device simulates the mouth but is hand held and is not designed to attach to the user's mouth area. The simulated tongue is designed to move freely in three dimensions but departs from what Hopper calls the "traditional vibrating" action.

SUMMARY OF THE INVENTION

The sexual aid device of this invention comprises a battery powered electric vibrator which attaches to the user's tongue. The first embodiment attaches to the tongue using a post which is inserted through a hole previously pierced in the tongue. The assembled device is shaped roughly like a dumbbell. It consists of a post with retainers mounted at either end. The post has a diameter narrow enough to fit through the tongue hole, but the retainers have larger diameter and cannot slip through the hole. At least one of the retainers have larger diameter and cannot slip through the hole. At least one of the retainers must be removable to allow device insertion. An electric vibration generator is incorporated into one of the retainers. An electric battery may be mounted in the same retainer as the vibration generator or in the other retainer.

The second embodiment attaches to the tongue using suction, constriction, and friction. One end of the device houses an electric vibration generator and battery The other end contains an airtight cavity into which the user inserts his or her tongue. The cavity is partially evacuated of air, creating a partial vacuum and producing suction. The force of the suction draws the tongue further into the cavity creating a secure attachment.

Accordingly, several objects and advantages of my invention are:

(a) to provide a vibrator which attaches securely yet comfortably to the tongue, or other body parts;

(b) to provide a tongue mounted vibrator which is quick and simple to attach and detach;

(c) to provide a tongue mounted vibrator which is small and lightweight;

(d) to provide a tongue mounted vibrator which causes minimal interference with normal movement of the jaw, lips, and tongue;

(e) to provide a tongue mounted vibrator which can be drawn completely within the wearer's mouth such that the mouth may be completely closed; and (f) to provide a tongue mounted vibrator which allows the wearer to utter understandable speech.

Further objects and advantages of my invention will become apparent from a consideration of the drawings and the ensuing description.

DESCRIPTION OF PREFERRED EMBODIMENTS

Figure 1:
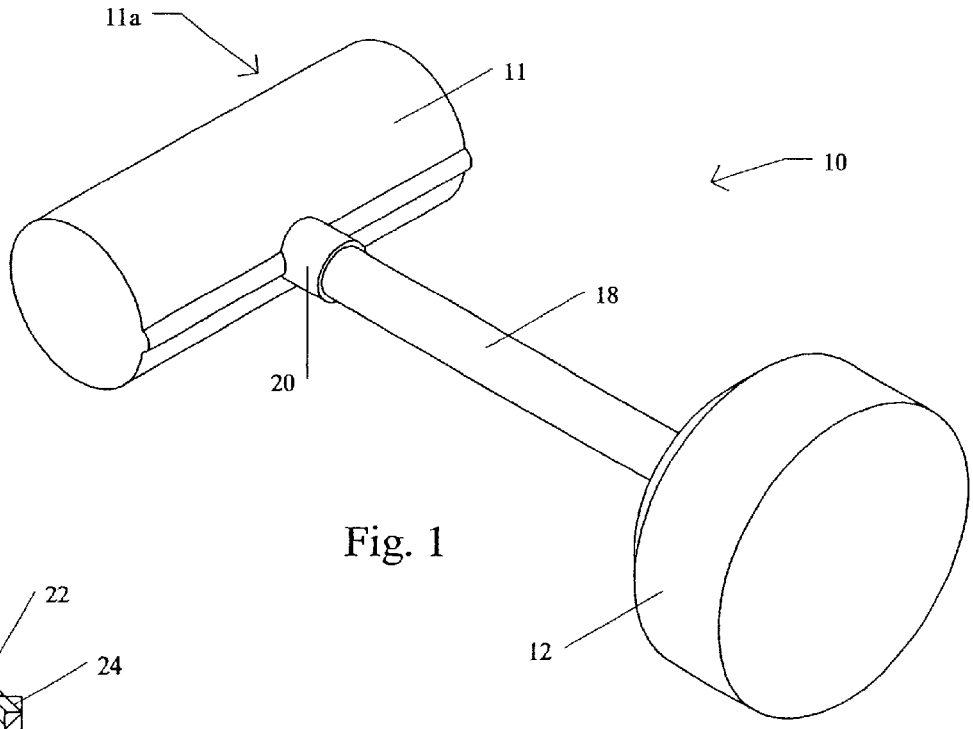
FIG. 1 shows a perspective view of the first embodiment of the vibrator.
Figure 3:
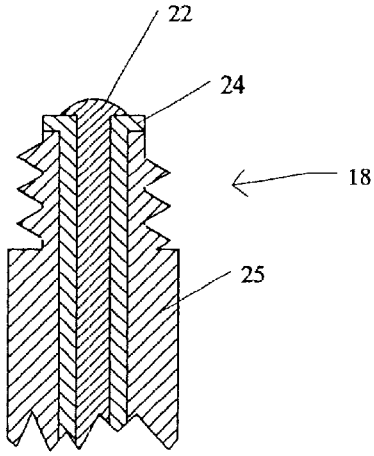
FIG. 3 shows a sectional orthogonal view of one end of the tongue post of the first embodiment of the vibrator.
Figure 2:
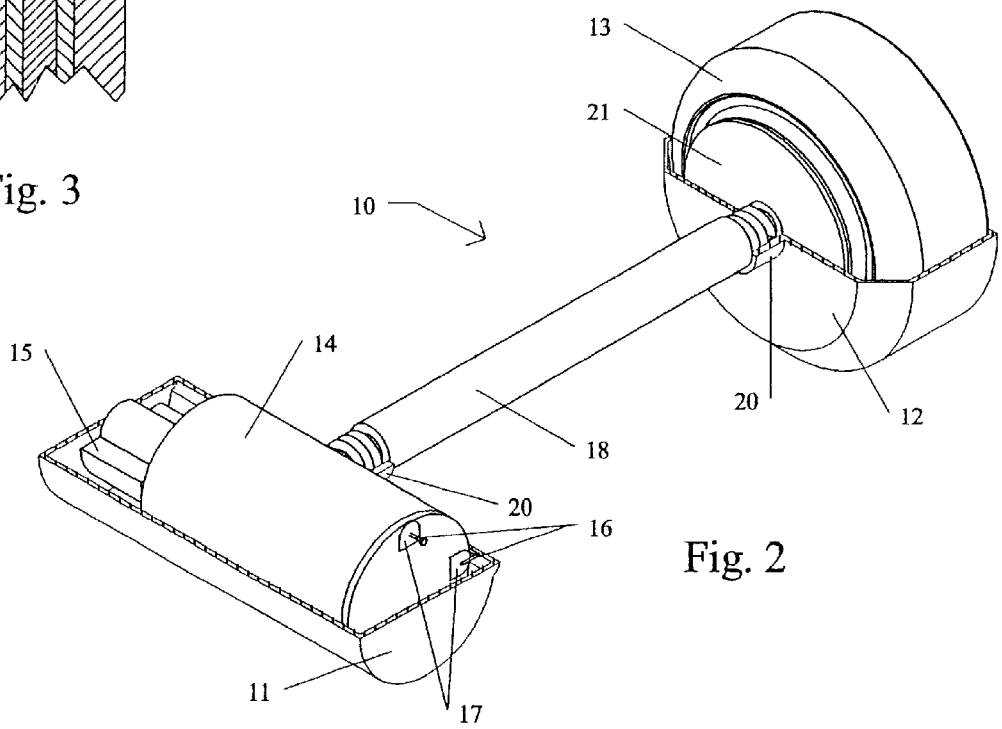
FIG. 2 shows a sectional perspective view of the first embodiment of the vibrator illustrating placement of the motor and battery.

FIGS. 1–3—First Embodiment

FIG. 1 shows in perspective the preferred first embodiment of the vibrator 10. The exterior of the upper end (left side of FIG. 1) is a moisture resistant vibrator housing 11 of a vibrator component 11*a*. The exterior of the lower end (right side of FIG. 1) is a moisture resistant battery holder 12. A tongue post 18 connects vibrator housing 11 to battery holder 12. One end of post 18 screws into a post socket 20 in vibrator housing 11, while the other end of post 18 screws into post socket 20 in battery holder 12.

FIG. 2 shows a sectional perspective view of the preferred first embodiment of the vibrator. Vibrator housing 11 and battery holder 12 are cut away to show the interior structures. Vibrator housing 11 contains a vibrator motor 14, wires 16, and two motor contacts 17. Motor 14 generates vibration by spinning an unbalanced weight 15 attached to the motor shaft. Two wires 16 conduct current from motor contacts 17 to the motor. Battery holder 12 contains a battery 13. The ground terminal of battery 13 makes electrical contact with battery holder 12. Insulator pad 21 has a flattened donut shape. Insulator pad 21 insulates the battery 13 non-ground terminal from battery holder 12. A hole in the center of insulator pad 21 allows a post conductor core 22 of tongue post 18 to make contact with battery 13 non-ground terminal (not visible in this figure). Vibrator housing 11, battery holder 12, and the exterior of tongue post 18 are made from stainless steel or other electrically conductive material, make electrical contact with each other, and together act as electrical ground for the device.

The vibrator motor 14 may be of a known type used in silent pagers, usually known as a vibration motor or a pager motor. For example, the motor can be one identified as "cylindrical DC motor of permanent magnet", Model OTL-6SL, manufactured by Jinglong Machinery & Electronic Co., Ltd. of Yuequing, Zhejiang, China. The cylindrical motor 14 is about 10 mm in length, and the eccentrically mounted weight 15 adds about 4 mm more to the length of the unit. The motor is about 5.5 mm in diameter. Preferably the motor/eccentric weight unit 14, 15 is less than about 20 mm in length and less than about 8 mm in width or diameter.

FIG. 3 shows a sectional orthogonal view of one end of tongue post 18 of the preferred first embodiment of the vibrator. Tongue post 18 is generally cylindrical and consists of three concentric layers. The exterior layer of post 18 is post ground 25. Post ground 25, made from stainless steel or other electrically conductive material, forms a hollow tube which is threaded at both ends. The middle layer of post 18 is post insulation 24. Post insulation 24, made from plastic or other electrically insulating material, forms a hollow tube which is flared at both ends. The center of tongue post 18 is post conductor core 22. Post conductor core 22, made from stainless steel or other electrically conductive material, is a solid cylinder which is flared at both ends. The ends of core 22 act as contacts to battery 13 non-ground terminal at one end, and motor contact 17, via wire 16, at the other. It will occur to those of ordinary skill in the art to arrange connection among battery 13, battery contacts 15, motor 14, and wires 16 as required and further detail will not be provided.

Figure 12:
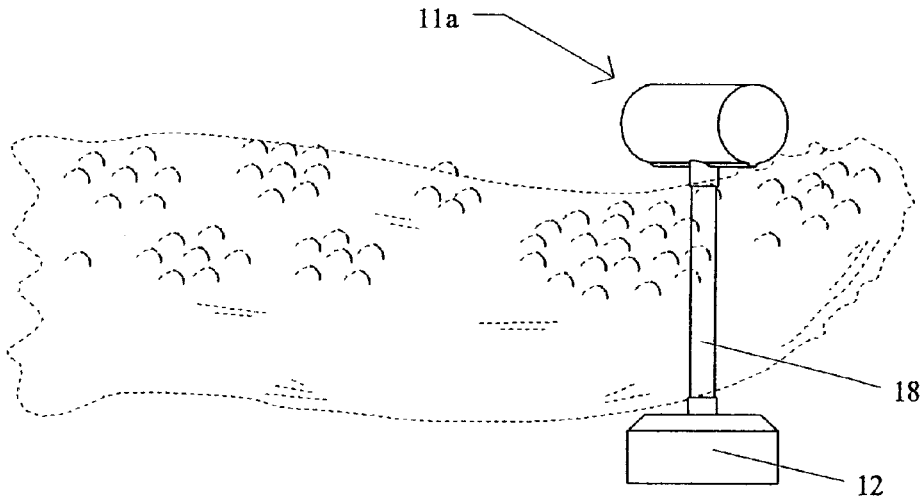
FIG. 12 shows the vibrator device of FIGS. 1–3 installed on a tongue.

The vibrator is attached by inserting post 18 through a hole previously pierced in the tongue, as shown in FIG. 12. The post 18 may be about 1 mm to 2 mm in diameter; a typical tongue post is about 1 mm in diameter, but a slightly larger diameter allows for the conductor and insulator 22 and 24 described above. Vibrator housing 11 and battery holder 12, mounted at either end of post 18, act as retainers. Post 18 has a diameter narrow enough to fit through the tongue hole, but vibrator 11*a* (i.e. its housing 11) and battery holder 12 have larger diameters and cannot slip through the hole. The vibrator is disassembled by unscrewing vibrator housing 11 or battery holder 12 from post 18. Post 18 is pushed through the tongue hole, the end is wiped to remove excess moisture, then the disassembled part is screwed back on.

The vibrator is powered on when the electrical contacts incorporated into post 18 make contact with the battery and motor contacts. The user may power down the device by slightly unscrewing post 18 from vibrator housing 11 or battery holder 12.

The vibrator should be removed when not in use. Testing has shown that a watch battery can power the device for a period of between 30 and 60 minutes and the vibrator should only be worn for a like period of time.

If desired, the device 10 can be used on other parts of the body which have been pierced.

Figure 4:
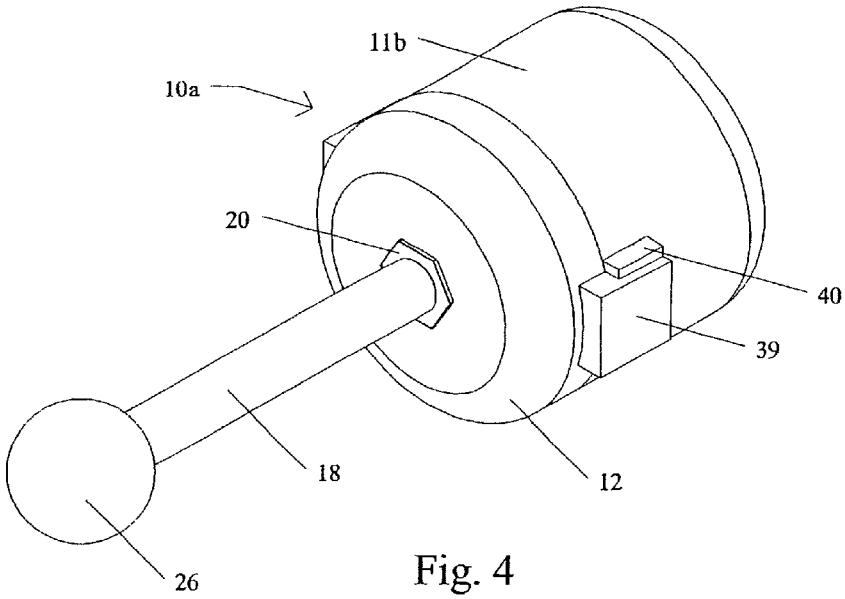
FIG. 4 shows a perspective view of an alternate first embodiment of the vibrator.
Figure 5:
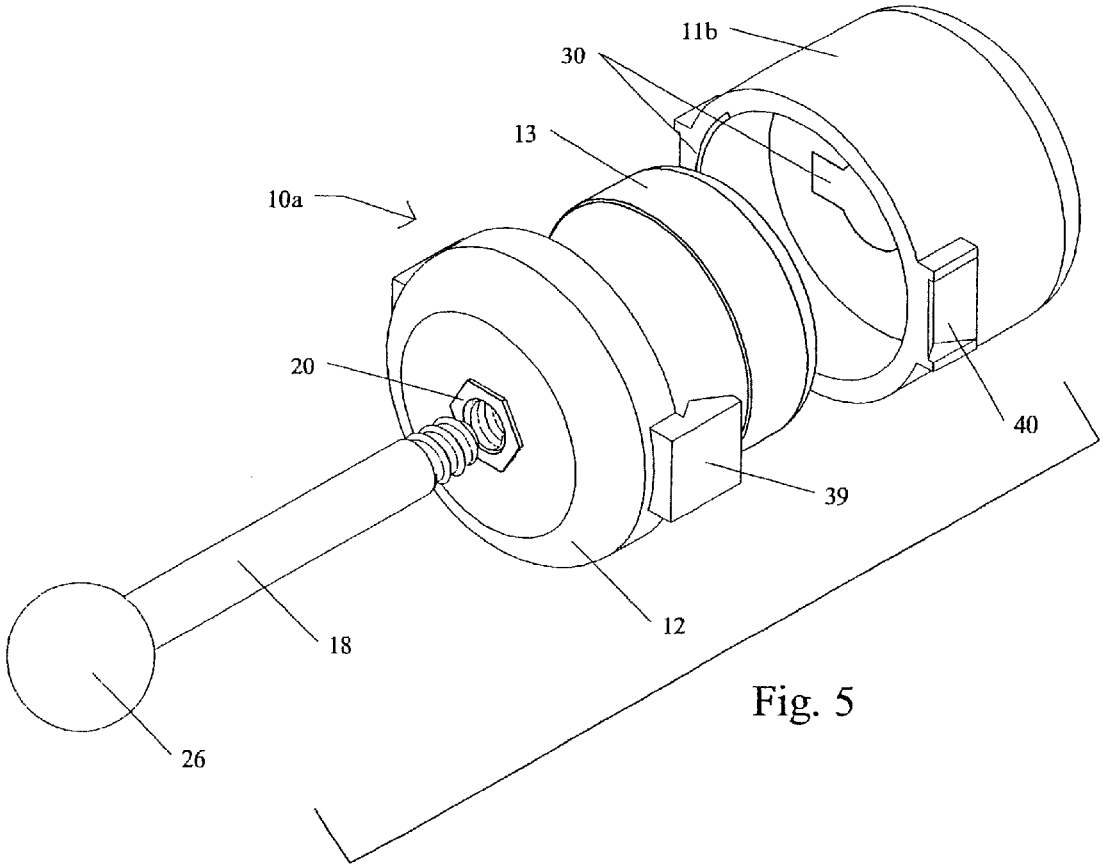
FIG. 5 shows a disassembled perspective view of an alternate first embodiment of the vibrator.

FIGS. 4–5—Alternate First Embodiment—Integrated Battery Holder and Vibrator Housing FIG. 4 is a perspective view of an alternate first embodiment of the vibrator 10*a*. Snap sockets 40 on vibrator housing 11*b* attach to snap tabs 39 on battery holder 12. Tongue post 18 screws into post socket 20 on battery holder 12. Retaining ball 26, attached to tongue post 18, acts as a retainer to keep post 18 from slipping out of the tongue hole.

FIG. 5 is a disassembled perspective view of an alternate first embodiment of the vibrator. It is similar to FIG. 4 but shows battery 13 and battery contacts 30, shows details of snap tabs 39 and snap sockets 40, shows details of post 18 and post socket 20. The battery 13, as in the above embodiment, may be a standard battery such as Toshiba LR44, about 11.5 mm in diameter and about 5 mm thick.

FIGS. 4 and 5 show both battery housing 12 and vibrator housing 11*b* attached to one end of the body-piercing post 18. In this case the connection between the post 18 and the vibrator housing can be described as indirect, since the battery housing is directly adjacent to the post end. The terms "secured", "connected", etc. as used in the claims are intended to refer to either direct or indirect connections unless otherwise specified.

FIGS. 6–10—Second Embodiment

Figure 6:
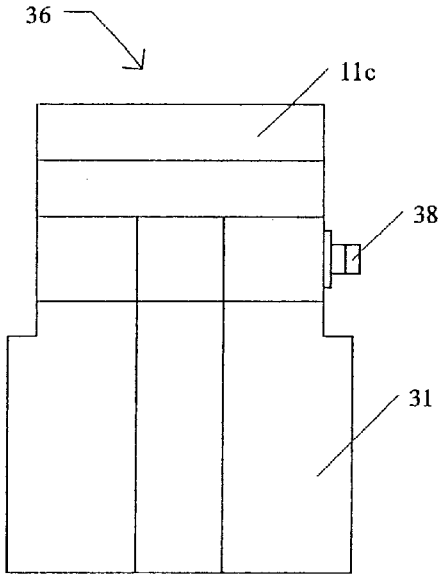
FIG. 6 shows a front orthogonal view of the second embodiment of the vibrator.
Figure 7:
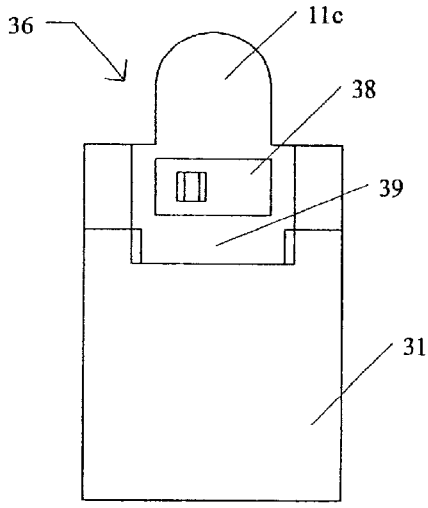
FIG. 7 shows a right side orthogonal view of the second embodiment of the vibrator.
Figure 8:
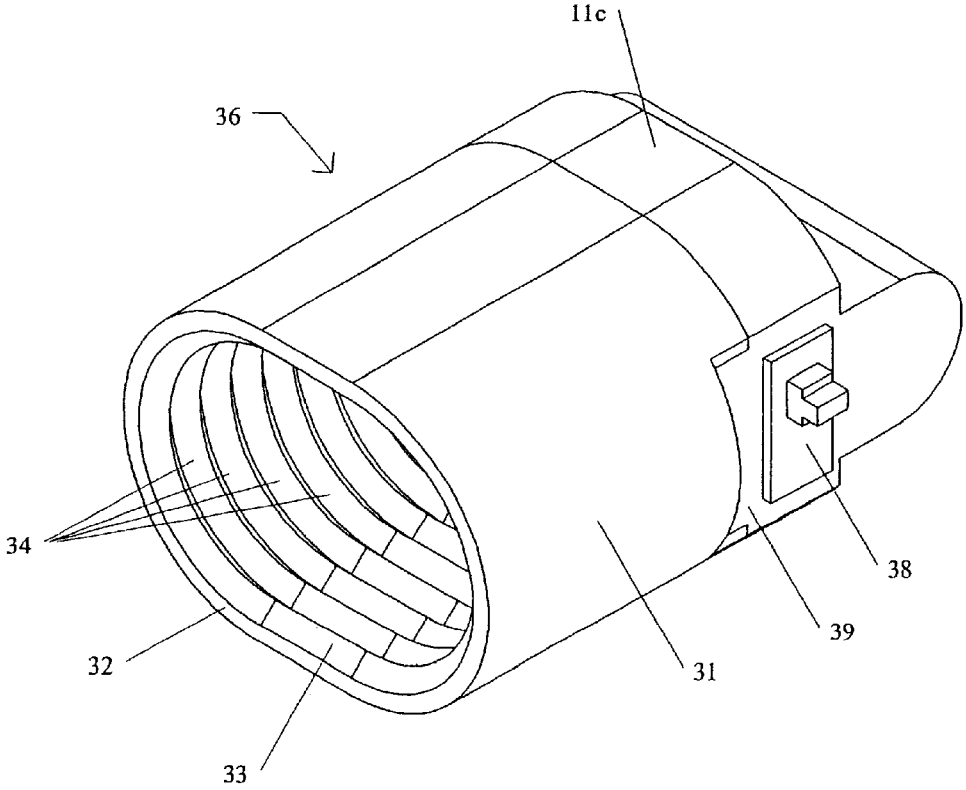
FIG. 8 shows a perspective view of the second embodiment of the vibrator.

FIGS. 6–8 show front, side, and perspective views of the preferred second embodiment of the vibrator 36. The exterior of the forward end of the device is a moisture resistant vibrator housing 11*c*. A mouthpiece 31 is attached at the distal end of the device. Mouthpiece 31 is molded from a pliable plastic such as urethane. The interior of mouthpiece 31 comprises an airtight cavity or tongue cup 32, which has a cylindrical or oblate cylindrical shape. Tongue cup 32, when partially evacuated of air, acts as the primary means of attachment to the tongue. Sealing lip 33 creates an airtight seal against the surface of the tongue. Mouthpiece 31 is pliable enough that sealing lip 33 can change shape slightly to conform to the shape of the tongue both for comfort and to better form and maintain an airtight seal.

A series of concentric raised rings or ribs 34 circle the interior of tongue cup 32. Friction ribs 34 grip the tongue and increase the friction between the tongue and tongue cup 32. Friction ribs 34 are acutely triangular in cross-section and are angled in such a way as to facilitate movement of the tongue deeper into tongue cup 32 and to inhibit the opposite movement. Friction ribs 34 also act as secondary or backup vacuum seals to sealing lip 33. Note that in this figure sealing lip 33 is illustrated as being shaped identically to friction ribs 34.

Figure 9:
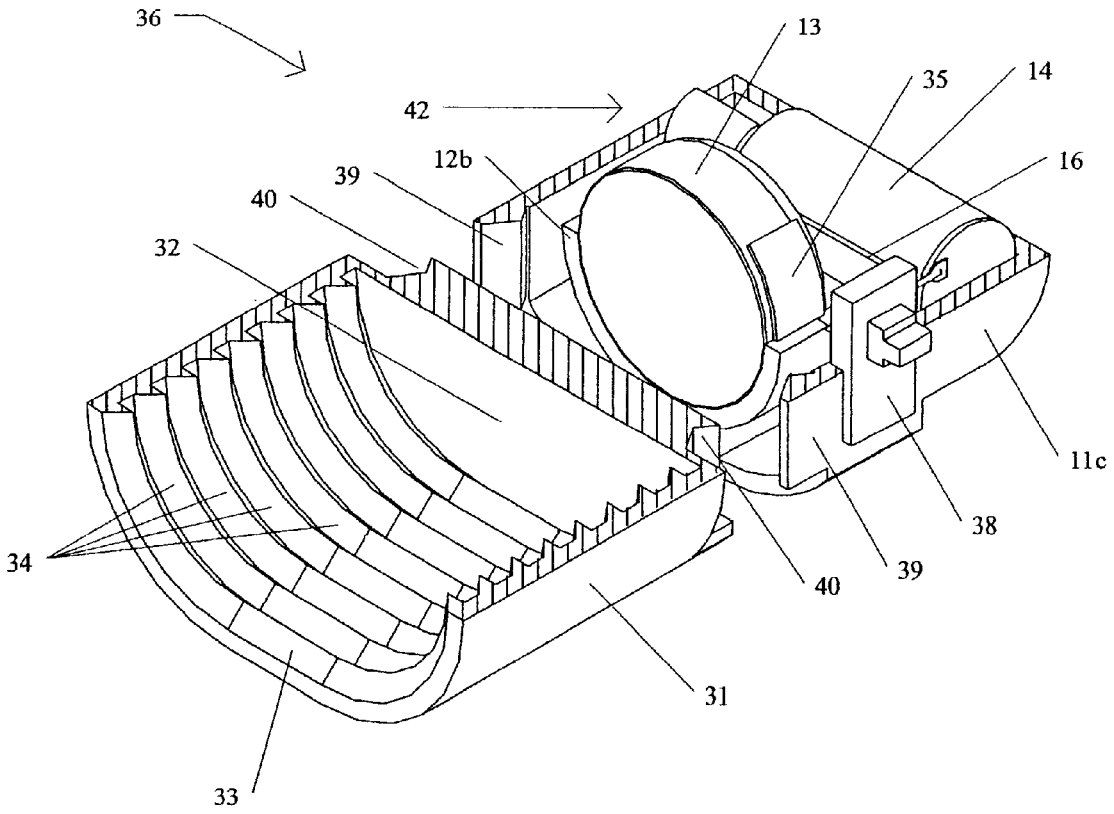
FIG. 9 shows a sectional perspective view of the second embodiment of the vibrator. It shows details of the interior of the mouthpiece and illustrates the vibration mechanism.

FIG. 9 shows a sectional perspective view of the second embodiment of the vibrator. Vibrator housing 11*c* is shown disassembled from mouthpiece 31. The sectional view of mouthpiece 31 reveals the interior of tongue cup 32 illustrating the shapes and positions of sealing lip 33 and friction ribs 34. Vibrator assembly 42 is encased in housing 11*c*. Housing 11*c* is snapped together with mouthpiece 31 by means of snap tabs 39 which fit into snap sockets 40. Battery 13 is removable and is accessed by separating housing 11*c* from mouthpiece 31. Battery holder 12*b* holds battery 13 in place against battery contacts 35 when mouthpiece 31 is connected to housing 11*c*.

Figure 10:
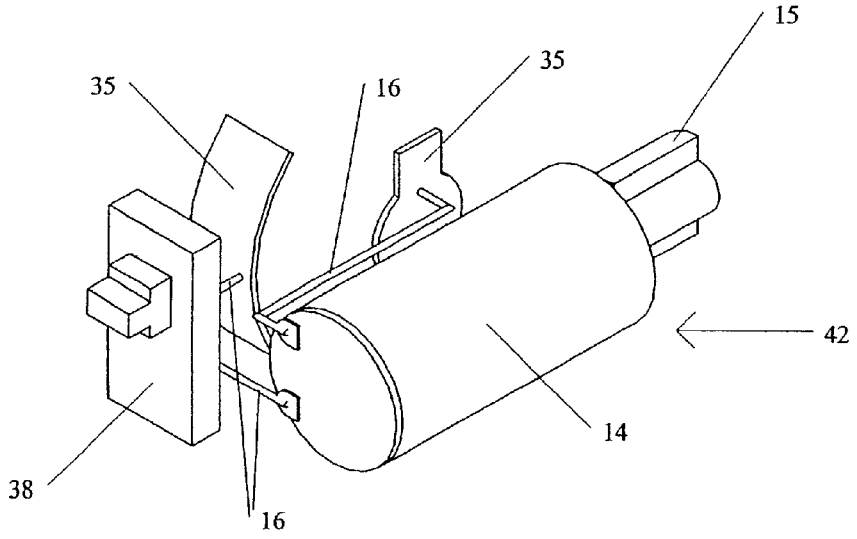
FIG. 10 shows an enlarged perspective view of the electrical components of the second embodiment of the vibrator. It shows the motor, switch, battery contacts, and wires. The vibrator housing, mouthpiece, and battery are not shown in this figure.

FIG. 10 shows an enlarged perspective view of vibration assembly 42. Vibration assembly 42 comprises a vibrator motor 14, switch 38, battery contacts 35, and wires 16. As above, the motor 14 generates vibration by spinning an unbalanced weight 15 attached to the motor shaft. An electric battery 13 (FIG. 9) powers the motor.

The switch 38 allows motor 14 to be powered on or off. It will occur to those of ordinary skill in the art to arrange connection among battery 13, battery contacts 35, switch 38, motor 14, and wires 16 as required and further detail will not be provided.

Figure 13:
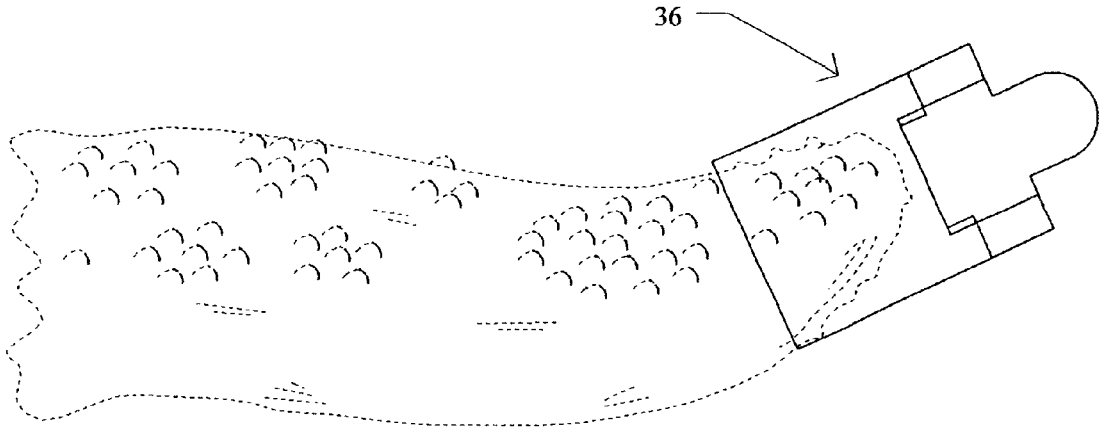
FIG. 13 shows the vibrator device of FIGS. 6–10 installed on a tongue.

To attach the vibrator the user inserts the tongue into tongue cup 32, as shown in FIG. 13. The user pressurizes cup 32 by sucking air out while pressing forward with the tongue. Optionally the user may aid evacuation of air from cup 32 by squeezing mouthpiece 31 at top and bottom with the fingers or by lightly biting down with the teeth.

Tongue cup 32 is shaped in such a way that the tongue does not completely fill the cup but instead leaves some unfilled volume. This unfilled volume or airspace is necessary for the maintenance of suction. Mouthpiece 31 is designed to change shape in response to the in-use air pressure differential between its inside and outside. To maintain suction, however, mouthpiece 31 must be firm enough that it resists complete collapse. In practice the thickness and stiffness of the walls are balanced such that a vacuum pressure is achieved that secures the vibrator but which is comfortable and safe.

The tongue mounted vibrator is held to the tongue by three synergistic forces: vacuum, friction, and constriction. Vacuum is created by the air pressure differential between the inside and outside of mouthpiece 31. Tongue cup 32 is stretched at its open end by the tongue acting as a wedge as it is drawn forward. Friction is created when ribs 34 and lip 33 press against the tongue surface. The tongue is constricted by lip 33 and ribs 34. This constriction both increases friction and forms a better vacuum seal.

The user may switch the vibrator on either before of after attachment.

Figure 11:
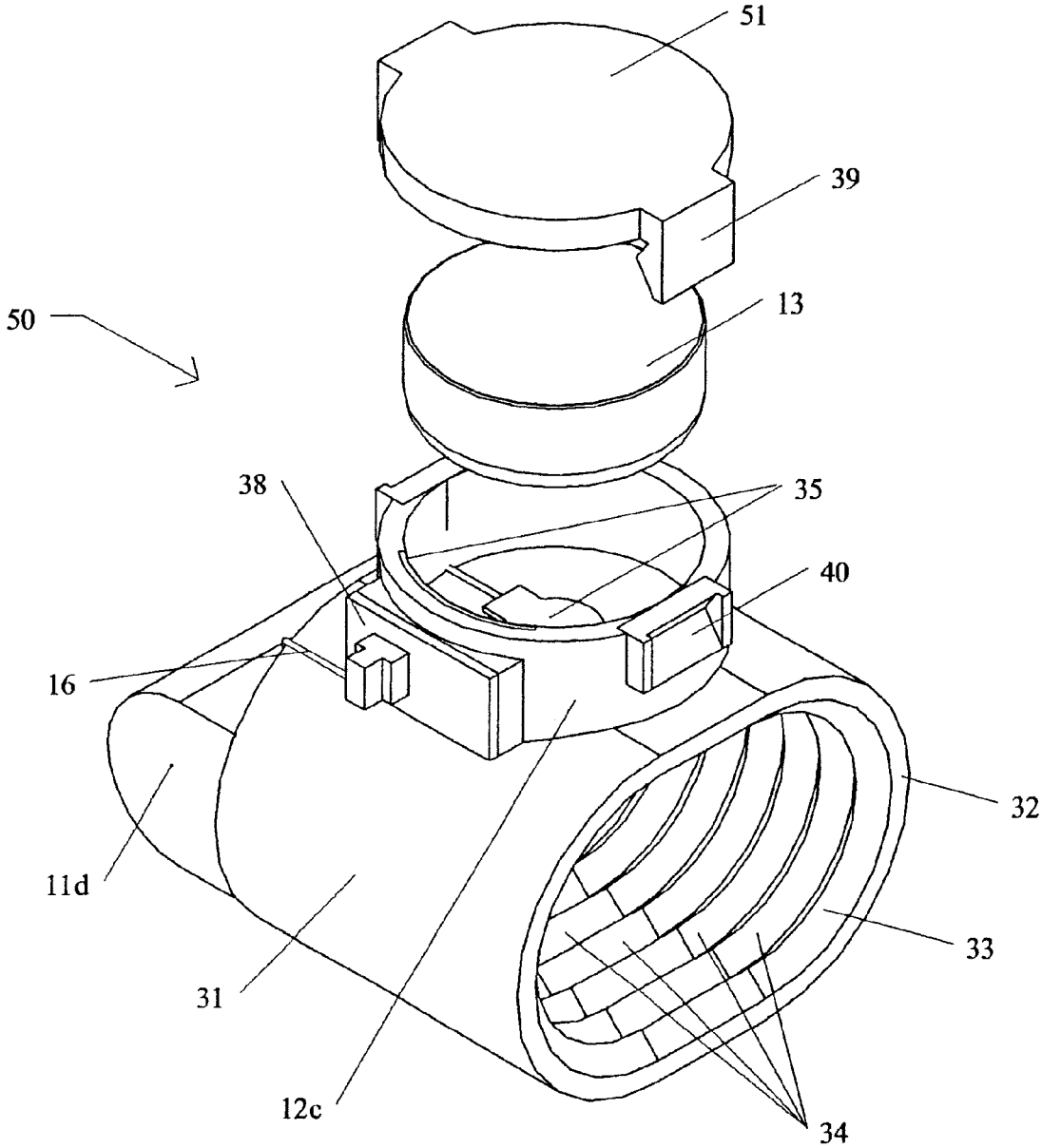
FIG. 11 shows a perspective view of an alternate second embodiment of the vibrator wherein the mouthpiece and vibrator housing are integral. This view shows the battery cap and battery disassembled.

FIG. 11—Alternate Second Embodiment—Integral Mouthpiece and Vibrator Housing FIG. 11 shows a perspective view of an alternate second embodiment of the vibrator 50 wherein mouthpiece 31 and vibrator housing 11*d* are integrated as a single unit. The main difference from the preferred embodiment illustrated in FIGS. 6–10 is that battery holder 12*c* is moved from the closed end of mouthpiece 31 to the top of mouthpiece 31. A removable battery cap 51 secures battery 132 and seals battery holder 12*c* against moisture.

The tongue mounted vibrator of this invention provides a small, lightweight vibrator that attaches securely yet comfortably to the tongue. The vibrator is quick and easy to attach and detach, and causes minimal interference with normal movement of the mouth. The vibrator can be drawn completely into the mouth and the mouth closed. The user can speak while wearing the vibrator.

Although the description above contains many specificities, these should not be construed as limiting the scope of the invention but as merely providing illustrations of some of the presently preferred embodiments of this invention.

In the first embodiment, for example, soft plastic sleeves might be fitted over the vibrator housing and battery holder to prevent hard surfaces from contacting the teeth; vibrator types other than unbalanced weight may be used, such as reciprocating weight, pulse generator, piezo-electric, etc.; a power switch might be added.

In the second embodiment, for example, the vibrator motor and battery may be mounted in a variety of positions, on top, bottom, sides, etc.; alternate methods for attaching the mouthpiece to the vibrator housing, such as screwing the two components together, could be used; vibrator types other than unbalanced weight may be used, such as reciprocating weight, pulse generator, audio, piezo-electric, etc.; the use of a switch is optional, the vibrator may be turned on/off by inserting/removing the battery; the vibrator housing and mouthpiece may be transparent, semi-transparent, or opaque and may be brightly colored in solids, patterns, and shapes; the vibrator housing and mouthpiece may be textured using ridges, bumps, and pits both for decorative purposes and to enhance tactile stimulation.

Further, the device particularly as shown in FIGS. 1–5 could be used on other parts of the body, such as the female genitalia. The term "post" or "tongue post" as used herein is intended to be broadly interpreted as applicable to any pierced part of the body, and to include a non-straight shapes such as rings, horseshoe shapes, etc.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A vibratory erotic stimulator, comprising:

a vibrator device comprising a battery-powered electric vibration generator, and a moisture resistant housing encasing said electric vibration generator, a mouthpiece formed into a hollow, tube-like shape, the mouthpiece being open at one end and closed at an opposite end thereof, the mouthpiece being generally of a size as to receive at least a portion of the tip of a human tongue, such that the open end provides space for insertion of the tip of the human tongue to extend a distance into the mouthpiece, means for securing the vibrator device to the mouthpiece, and a battery housing containing a battery, the battery housing being connected to the housing of the vibrator device and including conductors leading from the battery to the vibrator device to power the electric vibration generator, whereby the erotic stimulator can readily be secured to the tip of the tongue, held thereon by suction, and the stimulator can then be used for erotic stimulation.

2. The device of claim 1, wherein the mouthpiece has an open end which is of an oblated cylindrical shape, with a width greater than a height of said open end.

3. The device of claim 1, wherein the mouthpiece is formed of a soft, pliable, rubbery material.

4. The device of claim 3, wherein the mouthpiece is formed of polyurethane.

5. The device claim 1, wherein the vibrator device housing is secured to said opposite end of the mouthpiece.

6. The device of claim 1, wherein the electrical vibration generator comprises a pager motor, less than about 6 mm in diameter.

7. The device of claim 1, wherein the vibrator device housing is secured to a side of the mouthpiece, between said one end and said opposite end.

8. The vibrator device of claim 1, wherein the open end of the mouthpiece has a lip adapted for forming an airtight seal against the skin of a human tongue.

9. The vibrator device of claim 1, wherein the mouthpiece has an interior including a plurality of raised ribs, said ribs adapted for engaging the surface of the tongue to provide a suction seal and friction against the tongue.

10. The vibrator device of claim 1, in combination with a human tongue and retained on the tongue by suction, with the tip of the tongue extending into the open end of the mouthpiece.

* * * * *